United States Patent [19]

Schippers et al.

[11] Patent Number: 4,638,955

[45] Date of Patent: Jan. 27, 1987

[54] YARN HANDLING APPARATUS FOR WINDING MACHINE

[75] Inventors: Heinz Schippers; Erich Lenk, both of Remscheid, Fed. Rep. of Germany

[73] Assignee: Barmag Barmer Maschinenfabrik AG, Remscheid, Fed. Rep. of Germany

[21] Appl. No.: 715,902

[22] Filed: Mar. 25, 1985

[30] Foreign Application Priority Data

| | | | |
|---|---|---|---|
| Mar. 27, 1984 | [DE] | Fed. Rep. of Germany | 3411158 |
| Mar. 28, 1984 | [DE] | Fed. Rep. of Germany | 3411464 |
| Nov. 12, 1984 | [DE] | Fed. Rep. of Germany | 3441250 |

[51] Int. Cl.[4] ..... B65H 54/02

[52] U.S. Cl. ..... 242/18 PW; 242/18 R; 242/18 DD; 242/35.5 A

[58] Field of Search ..... 242/18 PW, 18 R, 18 DD, 242/35.5 A, 18 A, 47.03; 226/97

[56] References Cited

U.S. PATENT DOCUMENTS

| | | | |
|---|---|---|---|
| 3,241,234 | 3/1966 | Kiefer et al. . | |
| 3,488,010 | 1/1970 | Parry . | |
| 3,526,348 | 9/1970 | Morrocco III, et al. . | |
| 3,678,579 | 7/1972 | Slavik . | |
| 3,683,732 | 8/1972 | Juppet | 226/97 X |
| 3,690,530 | 9/1972 | Porter | 226/97 |
| 3,801,030 | 4/1974 | Kobatake et al. . | |
| 3,856,222 | 12/1974 | Wust . | |
| 3,895,725 | 7/1975 | Mayer . | |
| 3,899,809 | 8/1975 | Haberkern . | |
| 3,915,398 | 10/1975 | Corl | 242/35.5 A |
| 3,987,974 | 10/1976 | Mayer . | |
| 3,999,909 | 12/1976 | Schippers . | |
| 4,002,307 | 1/1977 | Turk et al. . | |
| 4,007,882 | 2/1977 | Isoard | 242/18 R |
| 4,023,741 | 5/1977 | Schar | 242/18 PW X |
| 4,041,686 | 8/1977 | Inaba et al. . | |
| 4,052,017 | 10/1977 | Schar | 242/35.5 A |
| 4,093,133 | 6/1978 | Hoffmann et al. | 242/18 PW |
| 4,108,388 | 8/1978 | Schar | 242/18 PW X |
| 4,116,395 | 9/1978 | Courvoisier | 242/35.5 A |
| 4,146,186 | 3/1979 | Burkhardt | 242/18 PW |
| 4,153,211 | 5/1979 | Lenk et al. . | |
| 4,181,247 | 1/1980 | McFall | 226/97 |
| 4,340,187 | 7/1982 | Schippers et al. | 242/35.5 A |
| 4,351,494 | 9/1982 | Schippers et al. . | |
| 4,416,041 | 11/1983 | Gujer et al. . | |
| 4,431,138 | 2/1984 | Schiminski et al. . | |
| 4,474,337 | 10/1984 | Schiminski et al. . | |
| 4,496,109 | 1/1985 | Cardell | 242/18 PW X |
| 4,519,115 | 5/1985 | Gujer et al. . | |

FOREIGN PATENT DOCUMENTS

| | | |
|---|---|---|
| 920596 | 11/1954 | Fed. Rep. of Germany . |
| 2123689 | 5/1971 | Fed. Rep. of Germany . |
| 2128974 | 6/1971 | Fed. Rep. of Germany . |
| 2547401 | 5/1976 | Fed. Rep. of Germany . |
| 3211603 | 11/1982 | Fed. Rep. of Germany . |
| 1380326 | 1/1975 | United Kingdom . |
| 1399891 | 7/1975 | United Kingdom . |

*Primary Examiner*—Stanley N. Gilreath

*Attorney, Agent, or Firm*—Bell, Seltzer, Park & Gibson

[57] ABSTRACT

A yarn handling apparatus is disclosed for a textile yarn winding machine of the type having a plurality of side by side winding positions extending along the length of the machine. A separate yarn handling apparatus is associated with each winding position, and each handling apparatus comprises an assembly which includes yarn catching means, yarn severing means, and yarn suction means for withdrawing the severed yarn end. The assembly is mounted for movement along a predetermined path of travel between a first end position located on the upstream side of the spindle and where the yarn catching means is adapted to engage the running yarn as it moves in its predetermined yarn traverse stroke, and a second end position located on the opposite side of the winding spindle and where the running yarn is adapted to be engaged by a yarn catching and severing notch on the associated empty bobbin tube. An embodiment is also disclosed wherein the winding machine includes a draw roll system, and there is further provided a movable yarn suction means for threading the advancing yarn about the draw roll system so that the yarn is helically disposed about groups of the draw rolls.

25 Claims, 29 Drawing Figures

YARN HANDLING APPARATUS FOR WINDING MACHINE

The present invention relates to a textile yarn winding machine having a plurality of yarn winding positions aligned along at least one side thereof, and more particularly, to an automatic yarn handling apparatus for each winding position of the machine.

In the operation of winding machines of the described type, there exists the problem of doffing the packages, i.e., the exchange of the wound full packages for empty bobbin tubes on which the next packages are to be formed. Normally, several packages are mounted coaxially on the winding spindle at each winding position, and the full packages are doffed by a procedure wherein the yarns in the area of the traversing triangles are individually caught, and then severed and removed from the traverse motion system and sucked into a hand guided suction gun. The full packages are then removed and empty bobbin tubes are placed onto the winding spindle, and each of the yarns is then placed on the associated tube by moving the suction gun downwardly into a threading direction, which guides the yarn oppositely to the direction of rotation of the package and partially around the empty tube. The gun and thus the yarn are also moved axially to one end of the tube, and so that the yarn enters a catching groove or other retaining means which are provided in the empty tube (note German Offenlegungsscrift No. 25 47 401). A package doffing operation is thus divided into the handling of the yarns on one hand, and the exchange of the full package for an empty bobbin tube on the other.

In U.S. Pat. No. 4,340,187 automated carriages are described which carry out the functions of yarn handling and package exchange separately from each other. However, such automated carriages can only be used for handling the yarn where a random exchange is acceptable, i.e., where the time of a package doff is determined by the availability of the automated carriages and not by the filling status of the respective winding positions.

German Auslegeschrift No. 24 38 364 and U.S. Pat. No. 3,999,909 disclose a winding apparatus which includes two alternately driven winding spindles which are mounted on a common turret, and the start-up of the spinning and winding operations is automated. The wasteless package doff by means of such a winding apparatus, is, for example, described in German Offenlegungsschrift No. 32 11 603, and U.S. Pat. Nos. 4,431,138 and 4,474,337. Such winding apparatus allows a fully automated package to be doffed at any desired time, and the package doff is substantially free from losses, i.e., there is no waste even during the intervals of the package doff.

The disadvantage of the above described winding apparatus is that winding positions with two winding spindles are more expensive than those with only one winding spindle. This disadvantage may however be acceptable by the avoidance of waste production, which is of great significance in particular in the case of coarse yarns, which necessitate a frequent package doff, and also by the avoidance of manual operations, which can be important when a day and night operation with minimum personnel requirements is desired.

It is an object of the present invention to provide a winding apparatus which avoids the technical complexity and cost which are necessarily associated with a winder having two winding spindles mounted on a rotatable turret, and which is adapted to automatically effect the yarn handling without the need for attending personnel. The apparatus of the present invention is suitable in cases where the loss of waste production during a package doff is less important, such as, for example, in the instance of fine deniers. Thus the present invention offers, with less technical resources, the advantages of a winding apparatus having two winding spindles mounted on a turret and which are alternately in operation, as described in the above prior patents.

These and other objects and advantages of the present invention are achieved in the embodiments disclosed herein by the provision of a yarn handling means which is associated with each winding position, and which is operable during the package doff. The yarn handling means is adapted for severing and withdrawing each yarn from its winding path, and for returning each yarn to its winding path upon completion of the package doff. More particularly, the yarn handling means comprises a unitary assembly which comprises yarn catching means, yarn severing means, and yarn suction means for withdrawing the severed yarn end. The assembly is mounted for movement along a predetermined course of movement and between a first end position on upstream side of the winding spindle where the assembly is adapted to sequentially catch the yarn, cut the yarn, and withdraw the cut yarn end into the suction means. The assembly and the severed yarn end is then moved to a second end position where the yarn may be caught on the new bobbin tube. The yarn handling means is also adapted for the handling of more than one yarn at a single winding position, and which are delivered to respective packages mounted coaxially on a single winding spindle. In this latter case, a separate yarn catching means, yarn severing means, and suction means are respectively associated with each tube placed on the winding spindle.

A first embodiment of the invention is characterized in that all members which are operative in a package doff, such as the catching means, severing means, and suction means, are integrated in a single device, referred to herein as the suction head assembly, with the suction head assembly being guided along a predetermined path in an automated course of movements.

The course of movements of the suction head assembly is controlled so that its path of movement starts at a catching or first end position, which is located adjacent the plane formed by the traversing triangle of the advancing yarn. Proceeding from this catching position, the path of movement extends partially around the winding apparatus, which includes the traverse motion system and the winding spindle, when viewed along the axis of the spindle. Preferably, the catching position is located adjacent a lateral marginal portion of the traversing triangle.

In addition to the movement component around the winding spindle, the path of movement includes a movement component which is parallel to the axis of the winding spindle. Thereby, the suction head assembly guides the yarn laterally out of the traversing range, and inserts the yarn into the so-called transfer tail device and into the yarn catching means of the empty tube, which is typically a circumferential slot or groove. In particular, the last portion of the path of movement is a movement parallel to the axis of the winding spindle, and so as to extend through the plane which is normal to the yarn catching groove.

For a clarification of terminology, it should be noted that the phrase "package doff" is understood to mean the handling of the yarn during the exchange of the full package for an empty tube. In a comprehensive sense, "package doff" is understood to be both the handling of the yarn as well as the exchange of the full package for an empty bobbin tube. This exchange can be done by hand, however, the automation of this exchange operation may be carried out by a doffing carriage mounted to travel along the machine front, and which employs a known pusher device to remove the full packages from the winding spindle. To doff the packages, the doffing carriage is positioned with a receiving pin aligned in front of the winding spindle, and the pusher device on the winding apparatus pushes the full packages onto the receiving pin. Thereafter, a suitable device pushes the empty tubes from the doffing carriage onto the winding spindle. Such doffing carriages are further described in U.S. Pat. Nos. 4,340,187 and 4,351,494.

Where the winding machine is associated with the spinning of man made fibers, the machine may include a spinning head and a pneumatic guide tube for delivering the fibers to the winding apparatus. In such cases, the path of movement of the suction head assembly of the present invention may be programmed so that the catching position for the thread-up operation is located directly adjacent the outlet of the pneumatic tube.

In one preferred embodiment, the suction head assembly is mounted to a pivoting arm, the pivotal axis of which is above the winding spindle when viewed in the direction of the advancing yarn. The path of the suction head assembly describes a circular arc, with the yarn traversing system and the winding spindle being positioned within its sector angle. The axis of rotation may be on the same machine part as the winding spindle, or on the same machine part as the traverse motion system. It should be noted however, that the winding spindle and the traverse motion system should be movable relative to each other, so that the traverse motion system can move relative to the winding spindle, as the package diameter increases.

In another embodiment, the axis of rotation of the pivoting arm, when viewed in the direction of the advancing yarn, is positioned below the winding spindle and on the side of the plane of the traversing triangle which is opposite the winder. In this instance, the pivoting arm may be constructed as a telescopic tube, so that the path of movement of the suction head assembly includes a translational component of movement as well as the axial and circular components.

In all of the above described embodiments, the pivoting arm employed to obtain the desired path of movement is also movable in a direction parallel to the axis of the winding spindle, and as a result, the suction head assembly is able to make an axial movement at the beginning and at the end of the thread-up movements.

Another embodiment distinguishes itself in that the complicated course of movement of the individual functional members is broken down, and that there is associated to each functional member only the motion which is necessary for it. In this embodiment, the functional members are mounted to a support housing which is disposed parallel to the winding spindle, and the support housing is adapted to move both along its longitudinal axis and perpendicularly thereto in a vertical plane. Fixedly connected to this housing are a suction device and a cutter, whereas the yarn catching devices are mounted for movement relative to the housing. In a preferred embodiment, the yarn catching devices are mounted to a pivoting system, which is hinged to the housing, and they also advantageously serve as a thread-up device. To this end, two yarn catching devices are arranged one below the other, each consisting of a horizontal catching blade extending generally parallel to the axis of the winding spindle. The blades also include vertically aligned extensions which have two parallel edges disposed obliquely to the plane of the advancing yarn. A yarn catch is thus formed at the acute angle between one edge of the yarn blade extensions and the adjacent edge of the blade. Such yarn catches are known per se and are, for example, described as gullet teeth, and they permit the yarn to enter while preventing the yarn from leaving. When the yarn catching devices are moved out into the traversing triangle, the yarn enters the associated pair of yarn catches. The path of movement of the yarn catching device and the yarn catches is predetermined so that the yarn advancing vertically between the yarn catches comes to lie immediately in front of the suction device and moves into the cutter, which are mounted on the support housing. By actuating the cutter, the yarn is cut, and it is drawn into the suction device. At this point in time, the advancing yarn is only in the upper yarn catch, and to thread-up the yarn, the support housing is moved vertically downwardly, and then the thread-up operation is performed by swinging the yarn catching device outwardly. In so doing, the advancing yarn is made to contact the winding tube, which is associated with the respective yarn catching device and suction device, and thus held between the winding tube, the yarn catching device and the suction device.

One advantage of the present invention resides in the fact that since the yarn suction system is arranged on the machine frame, a high suction capacity can be employed, so that the waste yarn can be reliably removed in the necessary quantities. The present invention also involves an apparatus which is adapted to completely handle the yarn during a package doff. The invention thus enables any desired doffing times, which again makes it possible to operate the winding apparatus at any desired time, i.e. to remove the full packages and install empty tubes at any time.

The present invention facilitates the possibility of employing carriages to doff packages and/or to transport empty tubes for the winding apparatus. Package doffing carriages typically have a receiving pin which can be aligned with the winding spindle, and onto which the packages can be pushed from the winding spindle. Then the package doffing carriage transports the packages to a creel or other receiving station. The tube transporting carriage has a tube magazine, and a device with which the empty tubes can be removed from the magazine and placed onto the winding spindle, which is then put back in operation. U.S. Pat. Nos. 4,340,187 and 4,351,494 describe a winding apparatus in which a package doffing carriage and a yarn handling carriage, which also serves to transport empty tubes, are adapted to travel automatically along the machine front of a plurality of winding positions, and which are further operatively interconnected as well as connected with each winding position. However, as distinct from the package doffer as disclosed in the above patents, the present invention provides that yarn handling operations are conducted during the package doff by stationary devices which are associated with each winding station, while two independent servicing carriages, one serving to remove and transport the full packages, and the other to transport and deliver empty tubes, are adapted to travel independently of each other along the machine front. The two carriages are operatively connected with the winding positions, and the devices for yarn handling of each position, so that yarn catching, yarn cutting, yarn suction, stopping the winding spindle, the receiving and transporting of the full packages by the doffing carriage, the supply and delivery of the empty tubes to the winding spindle, as well as the yarn thread-up of the yarns, are all conducted in an automatic sequence of operating steps.

In addition to the above-described winding units associated with spinning machines for producing man made fibers, and in which the orientation of the filament yarns is exclusively caused by the high delivery speed of the yarns from the spinning nozzle to the winding spindle, the present invention is also applicable to spinning machines adapted for the production of flat, industrial yarns, and in which the just-spun filament yarns are drawn below the spinning head by means of a draw roll arrangement, and then directly wound at a very high speed. This latter process is known as the spin-draw-takeup process. In the operation of such spin-draw-takeup machines, a specific problem arises with respect to the guidance of the yarns exiting from the spinning head around the draw rolls and before they are supplied to the winder. The draw rolls are located between the wetting device below the spinning head and the stationary yarn guide at the apex of the traversing triangle formed by the yarn in the winder. When a package is doffed in accordance with the present invention, the yarns are sucked off by the described handling device which is positioned below the stationary yarn guide, and again fed to the winder after an empty tube has been supplied, so that it is not usually necessary to guide the yarns around the several arrangements of draw rolls which may be present, each time a package is doffed. However, the procedure must be regularly carried out at the start of the spinning from a spinning head nozzle, and each time after a spinning nozzle has been serviced, or after a filament breaks in the drawing operation, which leads to laps on the draw rolls. For this reason, it is desirable to also automate the guidance of the yarns around the draw roll arrangements and to provide an associated yarn handling device for this purpose. This device may be either an integral part of the machine at each spinning position, or a mobile unit for a group of spinning positions which is adapted to be called, as needed, by the individual spinning positions.

According to the invention, a yarn handling device of the type for threading-up the yarns on the draw roll arrangement of a spinning machine, consists of a slide with a yarn suction system arranged thereon, and with the slide being adapted to move between the end of the spinning head and the yarn guide in several planes which are normal to the draw roll axes. The movement of the slide with the yarn suction system starts in a rear plane and moves several times around each draw roll arrangement, while advancing from the rear plane forwardly to the next adjacent normal planes. With such a yarn suction system, which is adapted to move in three dimensions linearly or helically in front of a draw roll arrangement, the yarns can be removed from below the spinning head, and guided several times around the respective draw roll arrangements. For this purpose, it is preferred that successive, linear movements are made, which are repeated with a slight axial displacement in a direction toward the free draw roll end. With a gimbal-type mount of the arm being employed, the yarn suction device may perform a circular movement around the draw roll arrangement which, is repeated in axially displaced planes, so as to avoid an overlapping of the strung-up yarns.

The handling device for guiding the yarns around the draw roll arrangement may be suspended, for example, from an overhead structure above the winding machine, and is adapted to move in a plane perpendicular to the winding spindle of the winder. Alternatively, it may be arranged with the slide on a carriage which travels on the floor in the longitudinal direction of the spinning machine from one winding position to another, and comprises supporting and guiding means for the slide. The movement of the slide is preferably carried out via a programmable path control, in particular by a microprocessor, which controls the several drive motors for the slide.

The automated operation of the yarn handling device may be programmed so that the movement of the slide with its yarn suction device starts in a yarn catching position, which is located adjacent the orifice of a guide tube connected to the spinning head, and to which the slide returns upon completion of the thread-up operation. With such a method of operation, the yarns are delivered after having been moved around the draw rolls to the suction nozzle of the yarn handling apparatus of the winder, and then cut. Also, the movement of the slide with the yarn suction device may be so programmed that all yarn handling steps up to the delivery of the yarn onto the empty winding tube can be successively carried out in a logic sequence.

Some of the objects and advantages of the present invention having been stated, others will appear as the description proceeds, when taken in conjunction with the accompanying drawings, in which—

Figure 10A:
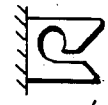
FIGS. 10 and 11 are side and front elevation views of an embodiment suitable for use in association with a yarn spinning operation.
Figure 10:
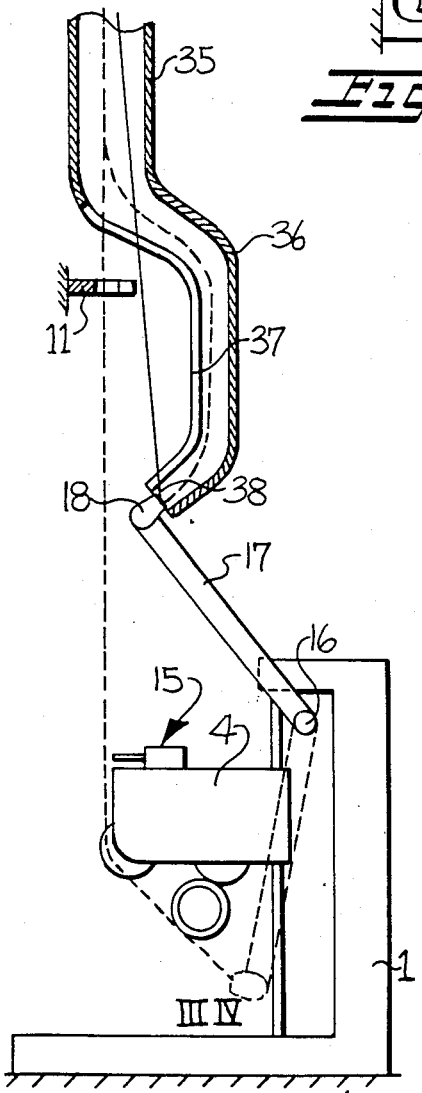
Figure 12:
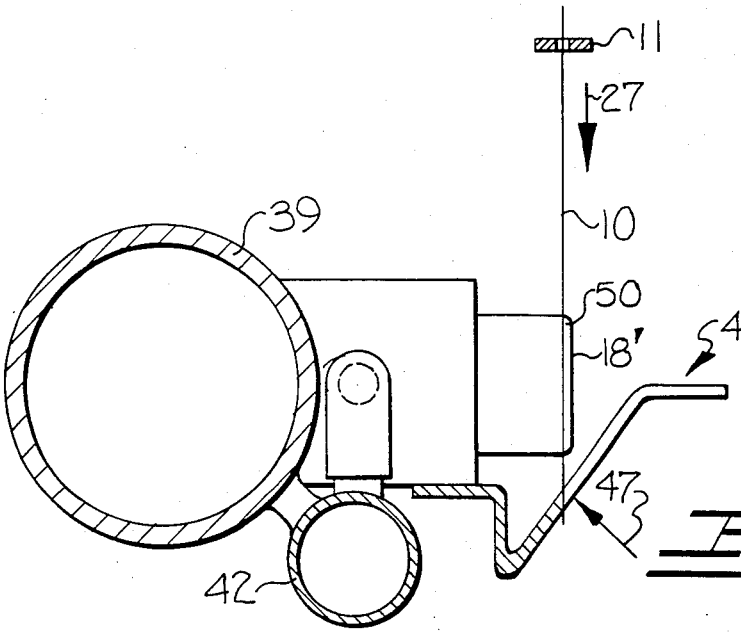
Figure 13:
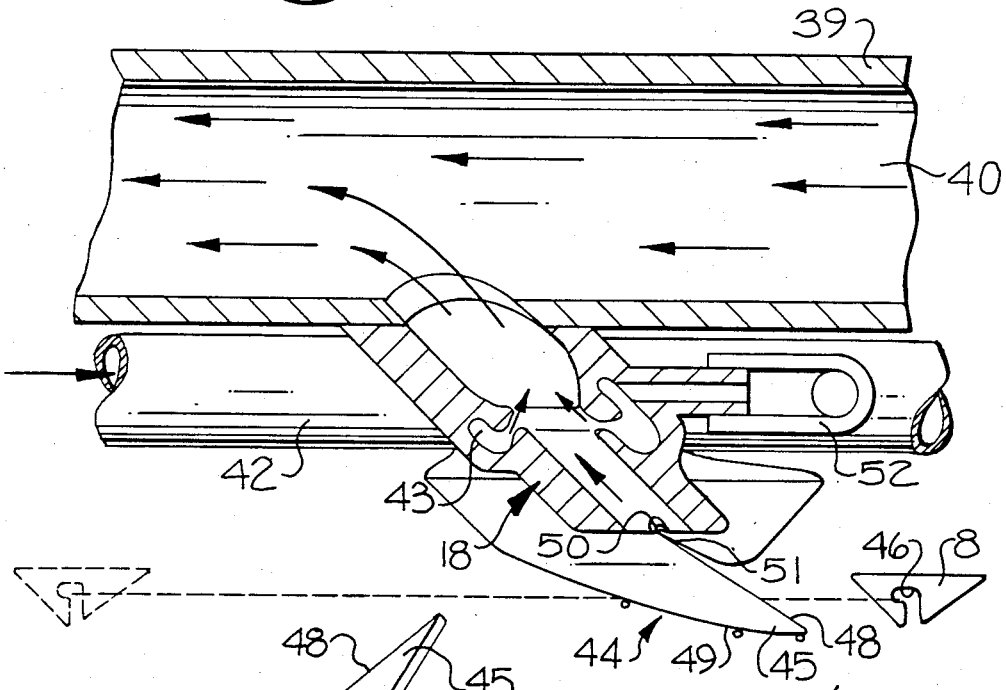
Figure 14:
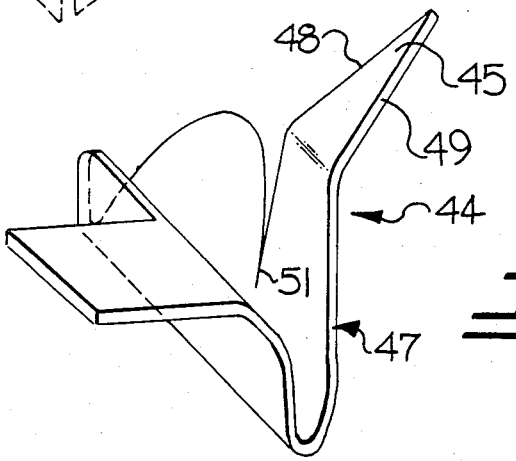
Figure 15:
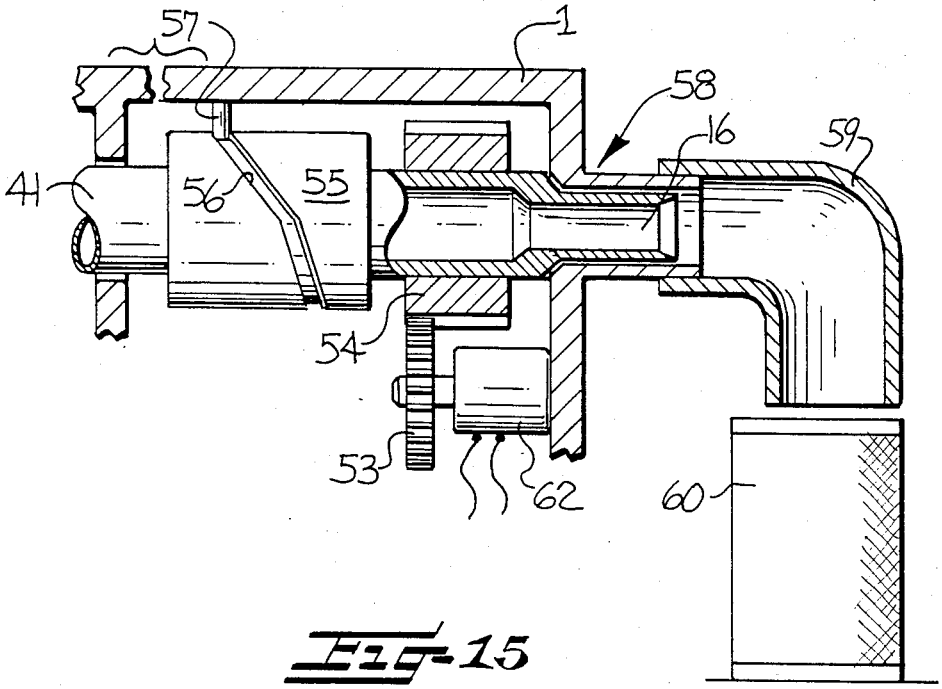
Figure 16A:
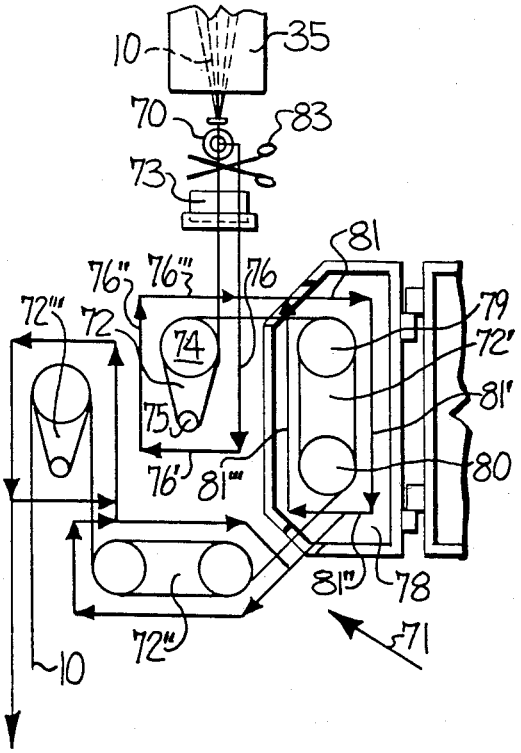

FIG. **10*a* is a plan view of the thread guide shown in FIG. 10**;

FIG. 12 is a fragmentary sectional side elevation view of the suction head assembly of the present invention;

FIG. 13 is a sectional top plan view of the head assembly shown in FIG. 12;

FIG. 14 is a perspective view of the yarn catching portion of the head assembly shown in FIG. 12;

FIG. 15 is a sectional view of the waste removal portion of the suction head assembly;

FIG. **16*a*** is a schematic front elevation view illustrating the arrangements of the draw rolls on a spinning machine, and further illustrating the course of movements of the yarn feeding device;

FIG. **16*b* is a side elevation view of the apparatus and movements shown in FIG. 16*a*;**

Figure 17A:
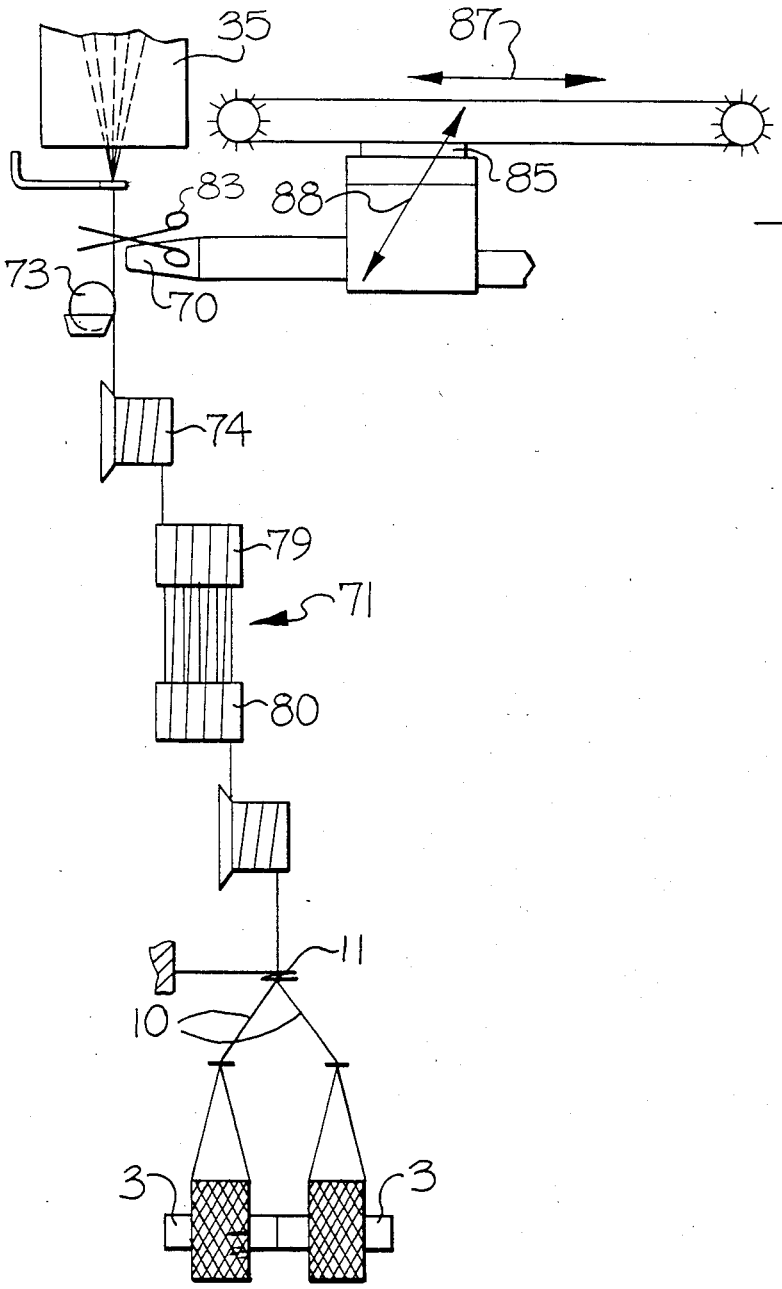
Figure 17B:
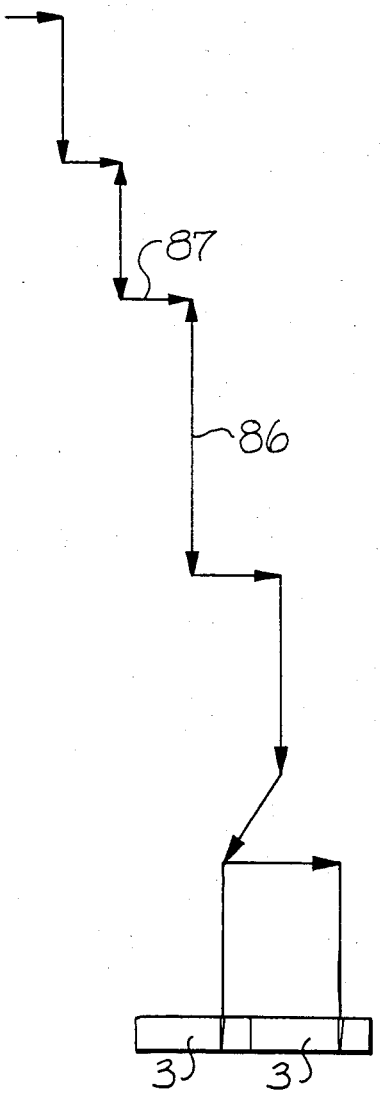
Figure 18:
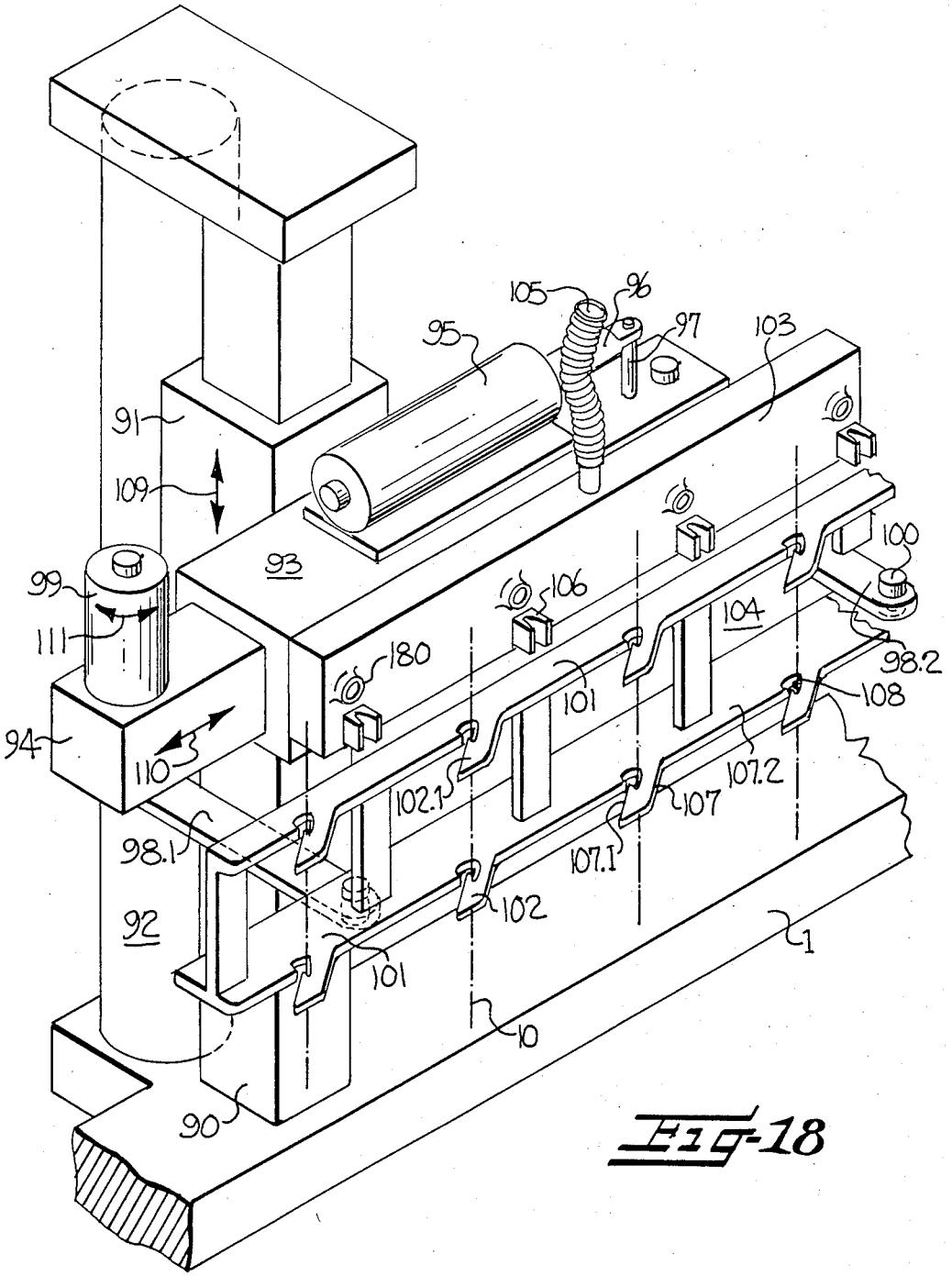
Figure 19A:
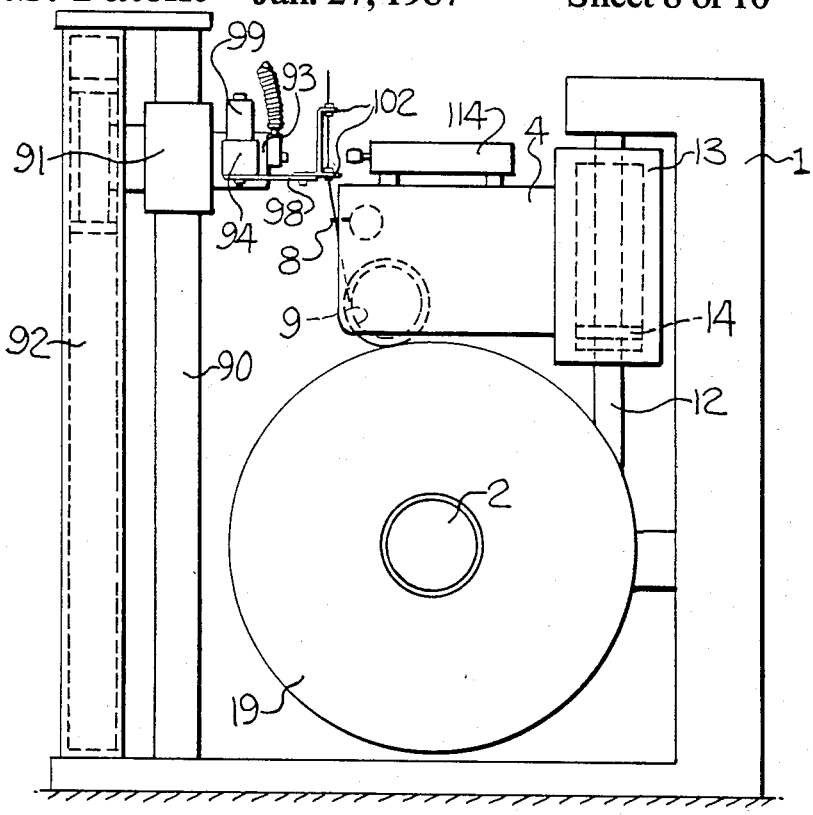
Figure 19B:
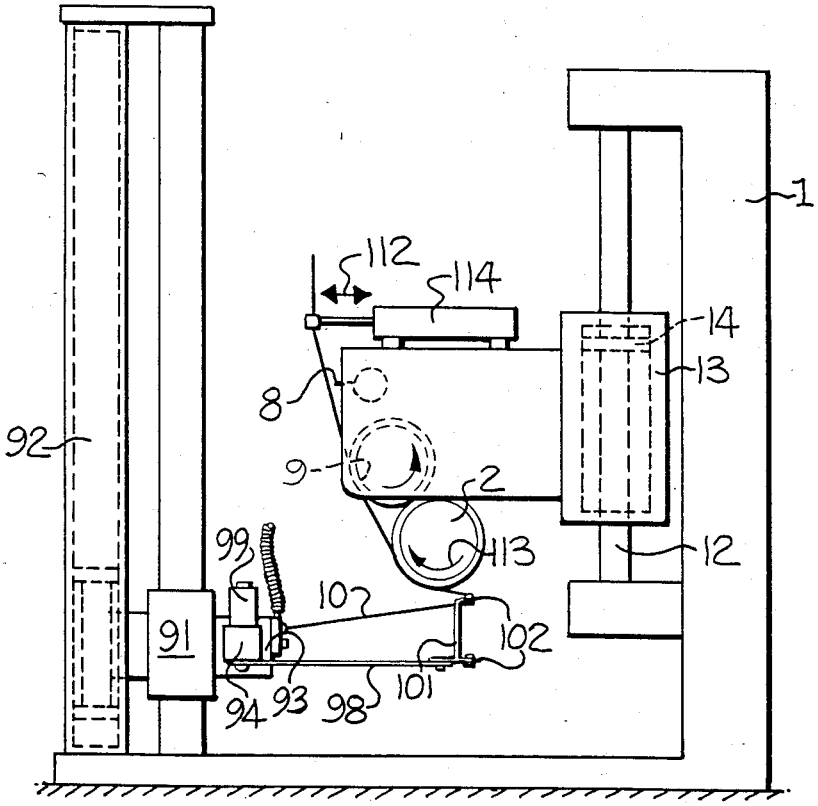
Figure 20:
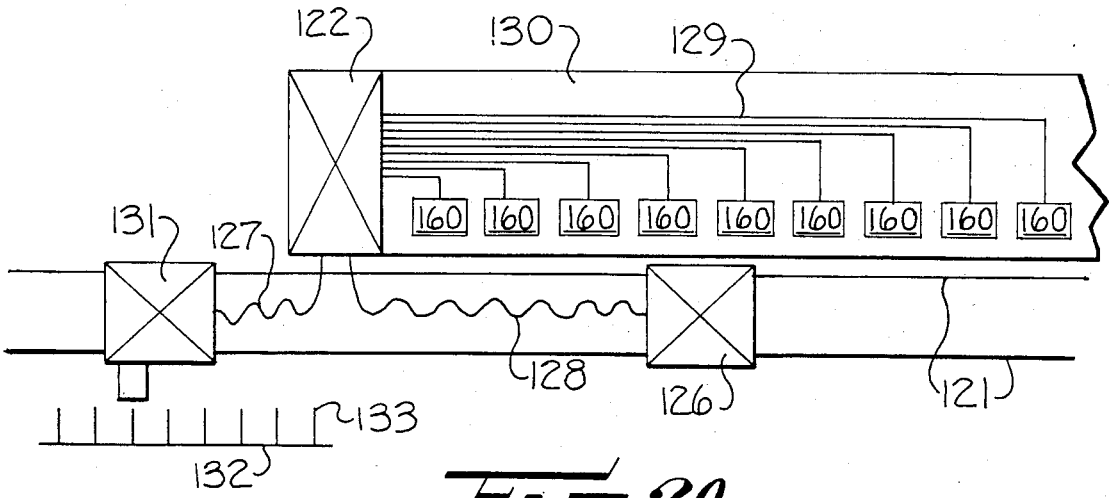
Figure 22:
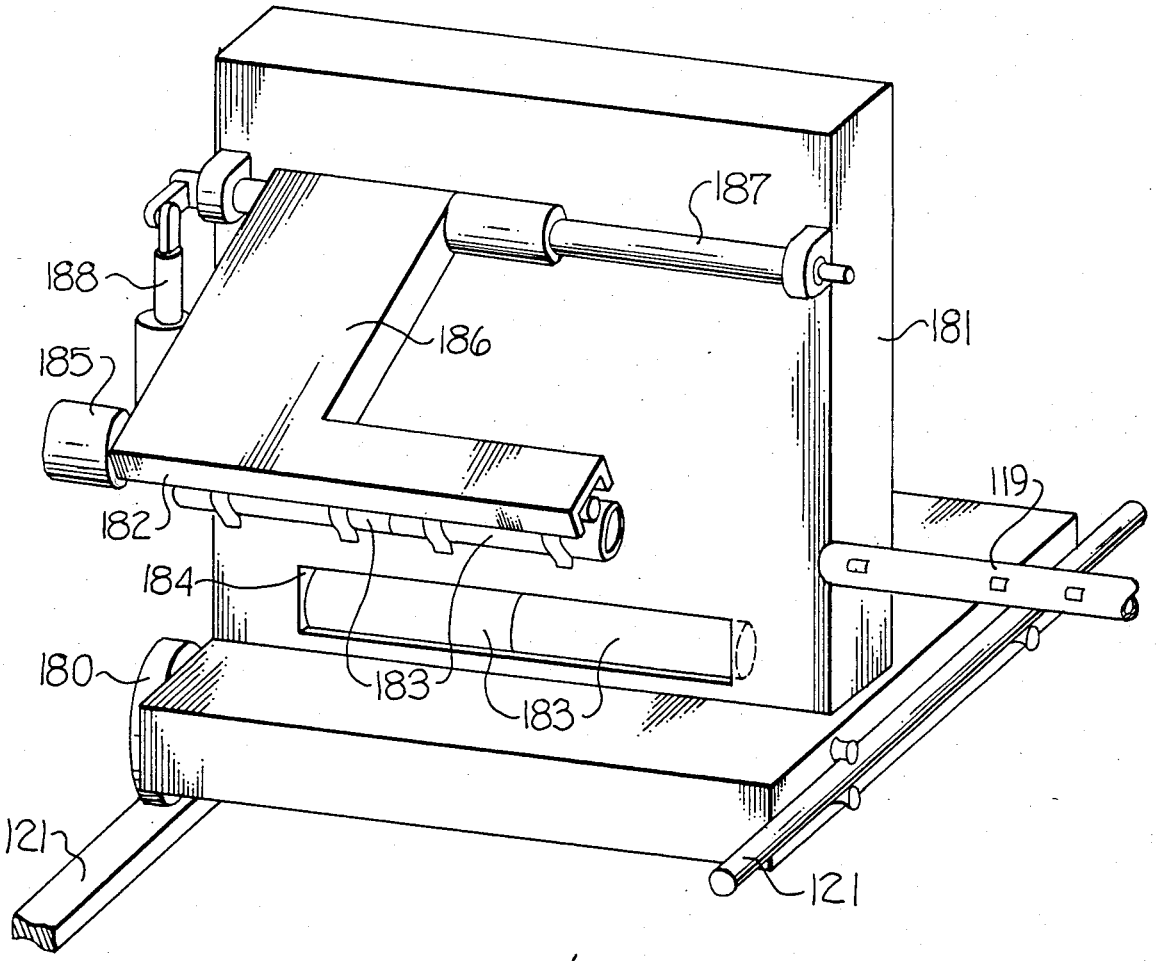

FIGS. 17*a* and 17*b* are side elevation views of a draw roll arrangement, and the path of movement of the yarn feeding apparatus;

FIG. 18 is a perspective view of a further embodiment of a yarn handling apparatus in accordance with the present invention;

FIGS. 19*a* and 19*b* are side elevation views of the yarn handling apparatus of FIG. 18, shown prior to and after the package doff;

FIG. 20 is a schematic plan view of a yarn winding machine, with a package doffing carriage and a separate tube transporting carriage mounted for movement along one side of the machine;

FIG. 21*a*–21*d* are perspective views illustrating the operating step of the package doffing carriage; and FIG. 22 is a perspective view of the bobbin tube transporting carriage.

Referring initially to the embodiment of FIGS. 1–8, a winding machine frame is generally indicated at 1, which comprises a plurality of yarn winding positions along one side thereof. Each position includes a single winding spindle 2, which is rotatably mounted for rotation about a fixed axis. The winding spindle has suitable clamping means to receive one or more empty bobbin tubes 3. On each empty tube a package 19 is wound from the continuously advancing yarn 10.

The machine frame 1 includes a straight mounting post 12, along which a slide 4 can move in the vertical direction. The movement of the slide is assisted by supplying compressed air to cylinder 13, which receives a piston 14. The slide also contains the traverse motion system 6 and drive roll 5. The movement of the slide causes drive roll 5 and traverse motion system 6 to move upwardly as the diameter of package 19 increases. In the illustrated embodiment, the traverse motion system 6 includes a fixed yarn guide 11, a driven cross-spiralled roll 7, which drives a laterally movable traversing yarn guide 8, as well as a grooved roll 9 which follows in the path of the yarn and around which the yarn partially loops before it is wound on package 19. Also mounted on the slide is yarn transfer tail forming device 15, which will be described below. Finally, the slide mounts a pivoting arm 17, which is adapted to pivot about axis 16, which is parallel to the axis of the spindle 2. The axis of rotation is thus moved with the slide. Also, pivoting arm 17 is also adapted to be moved parallel to its axis, i.e., in a direction parallel to the winding spindle 2. The drive for the traverse motion system 6, drive roll 5, yarn transfer tail device 15, as well as the pivoting drive and axial drive of pivoting arm 17, are not shown. The pivoting arm 17 is hollow and is connected to a suction connection. This suction connection leads, as described further below, to a waste yarn container. A tubular cross arm 39 is located at the free end of pivoting arm 17, and mounts a number of suction head assemblies 18. Cross arm 39 extends parallel to the winding spindle 2, and has as many suction head assemblies as there are packages being wound on the winding spindle.

Figure 6:
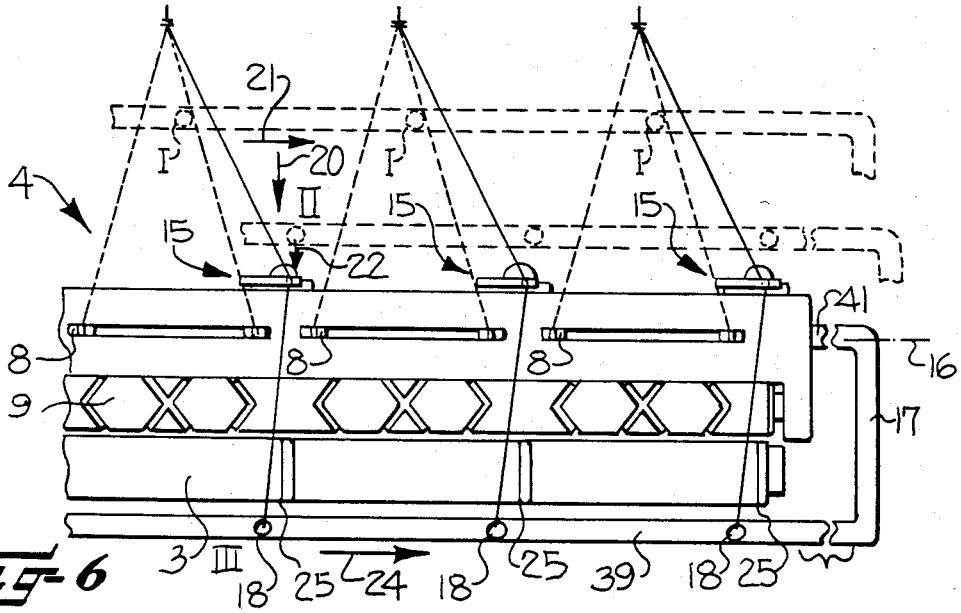
FIGS. 6 and 7 are front elevational views of the apparatus, illustrating several of the steps of the process.
Figure 7:
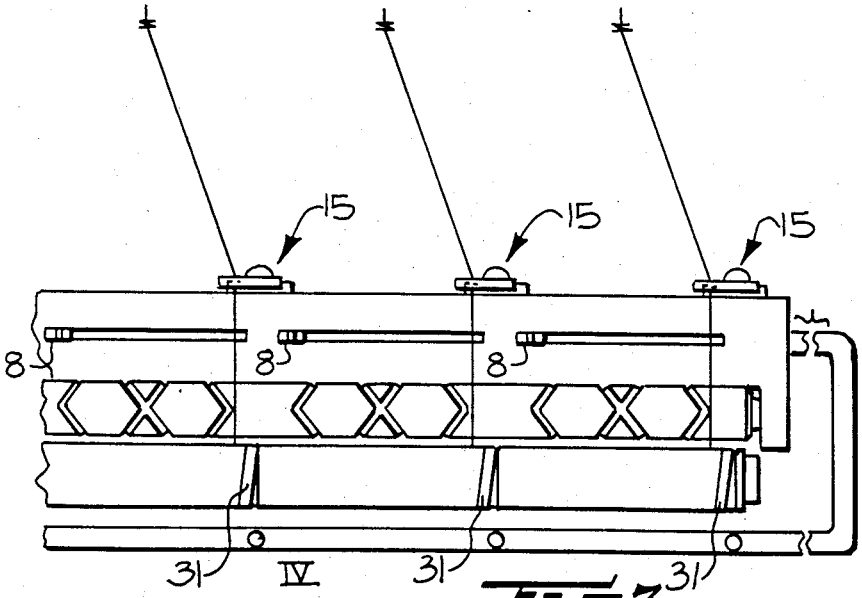

As is shown in FIGS. 6–7, several empty bobbin tubes 3 are placed closely next to each other on a winding spindle, and a corresponding number of traverse motion systems are coaxially arranged to each other on the slide 4.

Figure 1:
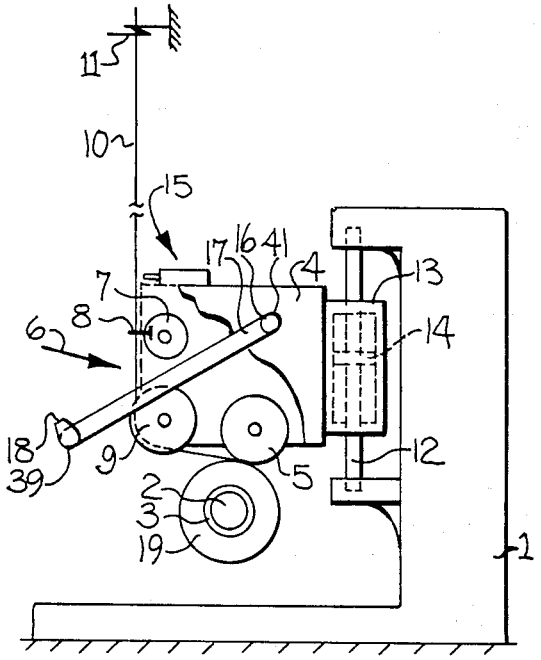
FIGS. 1–5 are schematic side elevation views of a winding apparatus embodying the features of the present invention, and illustrating the sequence of steps involved in the doffing process.
Figure 2:
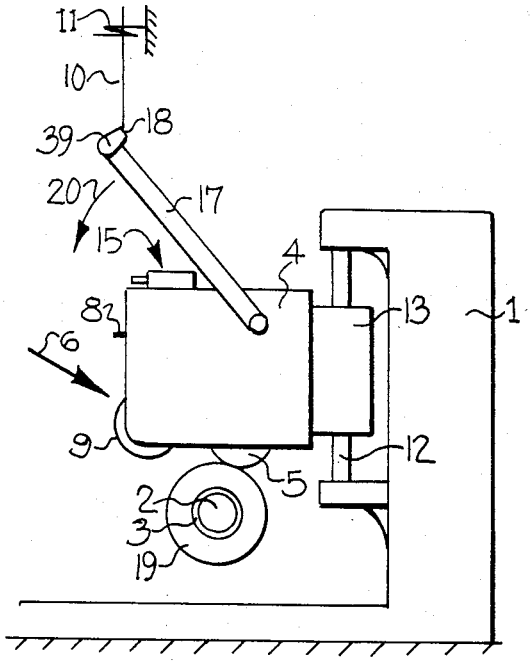

FIG. 1 illustrates the idle position of the pivoting arm 17. Pivoting arm 17 remains in this idle position while a package is wound, i.e., during the operation of the winding apparatus. As soon as the package has reached its desired or acceptable size, the package doffing operation is initiated. To this end, the pivoting arm 17 is initially pivoted to the yarn catching position as shown in FIG. 2, which is also indicated as position I in FIG. 6, so that the suction head assemblies 18 come to lie directly in front of the associated traversing triangles, and specifically at lateral marginal portion of the triangle. Each suction head assembly possesses a suitable yarn catching means, which catches the yarn as it traverses in the triangle, and guides the yarn in front of a suction inlet. Further, each suction head assembly possesses a cutting means, for example a yarn cutter or blade, which severs that yarn caught in front of the assembly between the suction inlet and package. After having been cut, the yarn can be sucked off by the suction inlet.

Figure 3:
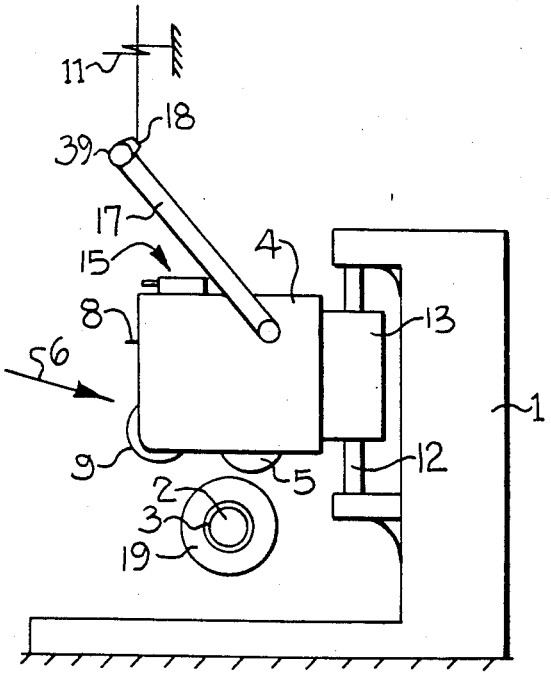

Upon the package 19 reaching full size, the slide 4 moves upwardly as the cylinder 13 receives pressurized air, so that the frictional contact between drive roll and package 19 no longer exists, note FIG. 3. In this position, the full package can be exchanged for an empty bobbin tube. To this end, package 19 is removed from the winding spindle 2, and another empty bobbin tube 3 is placed on the spindle.

Figure 4:
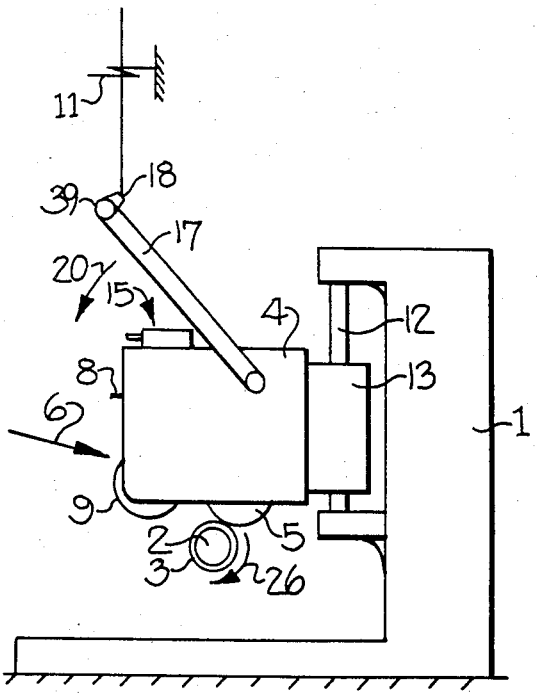
Figure 5:
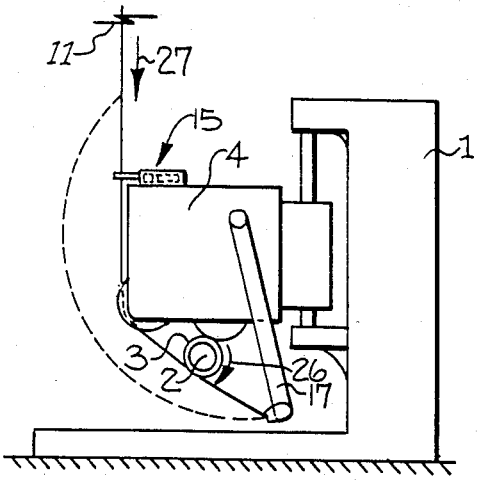
Figure 8:
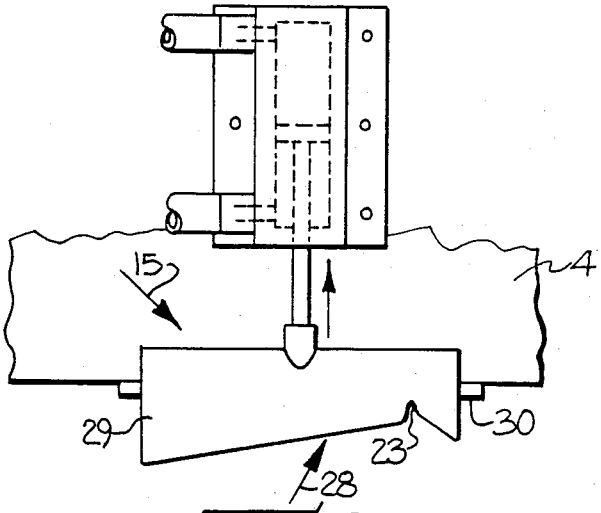
FIG. 8 is a top plan view of the transfer tail forming device of the apparatus.

The slide 4 is then lowered to the position shown in FIG. 4. This causes the winding spindle 2 and the empty tube placed thereon to rotate from the contact with the drive roll 5. Pivoting arm 17 is then pivoted in the direction of arrow 20, and axially moved at the same time in direction of arrow 21 (FIG. 6), so that the suction head assemblies pass through position II (FIG. 6). As the pivoting movement continues in the direction of arrow 22 (FIG. 6), each yarn moves into the gap 23 of the associated yarn transfer tail device 15 (FIG. 8). As the pivoting motion 22 further continues, the pivoting arm 17 receives an axial component of movement, so that it finally reaches the pivoted position shown in FIG. 5, and the position indicated at III in FIG. 6. The pivoting arm then undergoes an axial movement in direction of arrow 24 (FIG. 6), until suction head assemblies 18 reach the position IV shown in FIG. 7. During this movement, each yarn slides across the yarn catching notch 25 which is provided in each empty tube 3. This notch is a narrow continuous slot in which the yarn is clamped and torn off. This clamping action and the tearing are facilitated in that the direction 27 of the advancing yarn is opposite to the rotational movement 26 of the empty tube (FIG. 5). After the yarn has been torn off, pivoting arm 17 returns immediately to its idle position (FIG. 1), since otherwise the increasing package build would prevent it from doing so. At the same time, the yarn transfer tail device 15 is put in operation. As shown in FIG. 8, the yarn transfer tail device 15 comprises a plate 29, with a yarn groove 23 and a braking edge 28, and which is moved by a cylinder-piston unit perpendicularly to the traversing triangle. Behind the plate 29 is a stripping edge 30. The plate 29 is initially extended outwardly to catch the yarn in the groove 23, and is then withdrawn. The fact that the transfer tail device 15 is installed laterally outside of the traversing path results in the yarn sliding along the stripping edge 30 and the braking edge 28 in a direction toward the center of the traverse stroke, when the plate 29 is returned, and at a speed which is predetermined by the speed of plate 29, thus forming a transfer tail winding 31 on each empty tube which is outside of the traversing stroke and outside the package to be built on the empty tube.

Figure 9:
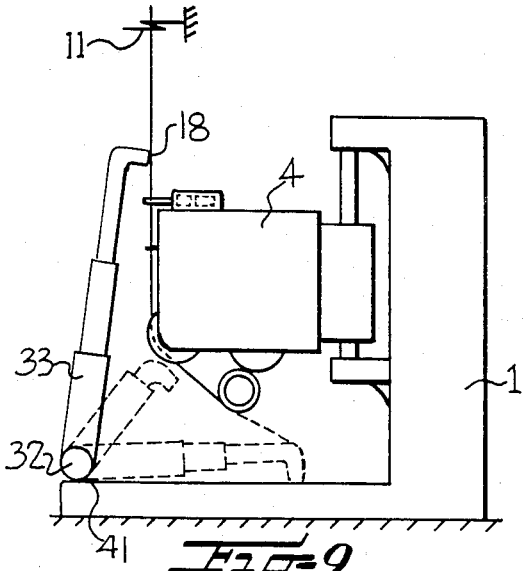
FIG. 9 is a view similar to FIGS. 1–5 and illustrating a different embodiment of the invention.

The embodiment illustrated in FIG. 9 generally corresponds with respect to both its setup and the motional sequence of the suction head assembly 18 to the embodiment described in conjunction with FIGS. 1–8. In this case, however, each suction head assembly is a part of series of telescoping tubes 33 which are mounted on the machine frame below the winding apparatus. This allows the suction head assemblies an additional degree of freedom, in that each can be pivoted, axially moved, and furthermore moved radially to the axis of rotation 32 of the tubes 33. Otherwise, however, the motional sequence is identical with the positions I, II, III, IV, as shown in FIGS. 6—7. The only difference is that the idle position can also be in contact with the base plate of machine frame 1, which is permitted by the described additional degree of freedom in the mobility of each suction head assembly 18. Each telescopic tube is located on a common central tube 41, and is adapted to pivot about the common axis of rotation 32.

Figure 11:
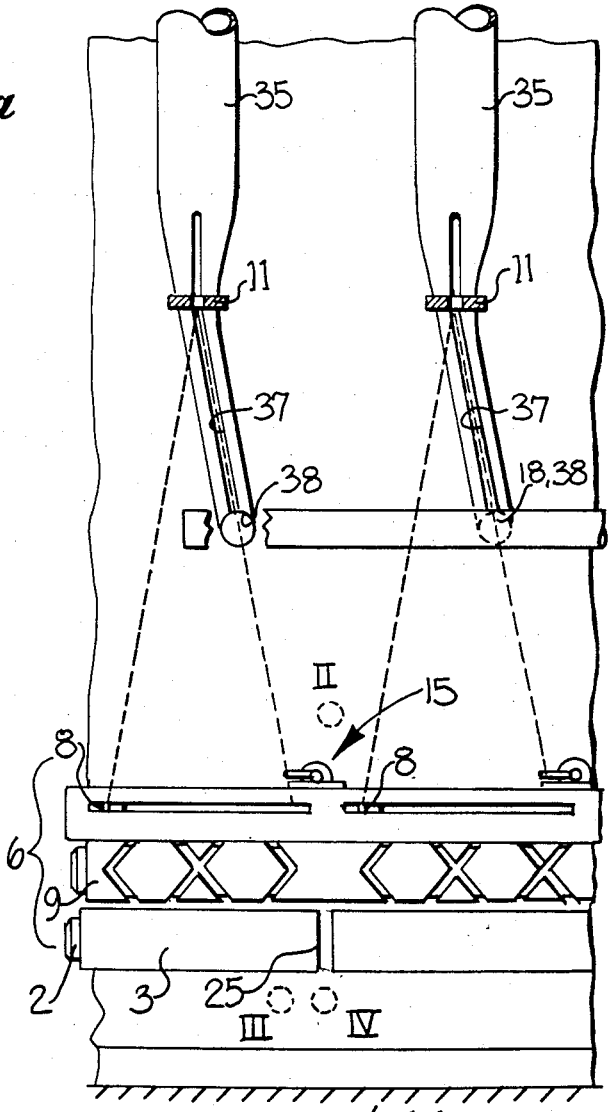

FIGS. 10 and 11 illustrate an embodiment which distinguishes itself over the previously described embodiments in that the axis of rotation 16, about which the suction assemblies 18 are pivoted, is stationarily arranged with respect to the machine frame 1. This stationary mount of the axis of rotation has the advantage that the weight of the slide is not increased by the yarn catching, cutting, suction and thread-up devices. The sequence of movements in the pivoting and axial directions corresponds to that of the embodiments of FIGS. 1–8. The other substantial difference, which could also be realized if the axis of rotation were on slide 4, is that the yarn catching, suction and thread-up devices are adapted to assist in a spinning start. "Spinning start" is here understood to mean the operating procedure by which a spinning process is put in operation. Details concerning an automated spinning start are, for example, described in German Pat. No. 24 38 364 and U.S. Pat. No. 3,999,909. However, while in this patent the package doff is automated by the use of a winder with two winding spindles, in the embodiment of FIGS. 10 and 11, both the spinning start and the package doff are automated by the same device.

In order to facilitate a spinning start, the embodiment of FIGS. 10 and 11 includes a spinning shaft 35, through which the yarn 10 or the individual filaments are delivered from the spinneret. An arcuate guide tube 36 is attached to the lower end of the shaft 35, and the tube 36 is provided with a slot 37 on the side facing the center of curvature. The tube ends at an orifice 38. The suction inlet of the head assembly 18 can be moved so that it comes to lie in its initial position in front of orifice 38, and essentially closes the same. By the air flow present in the spinning shaft 35, and assisted by the suction current of suction head assembly 18, the yarn is blown through guide tube 36 and grasped by the suction head assembly. In so doing, the yarn is subjected to tension so that it exits through slot 37. By pivoting the arm 17, the yarn is pulled into the yarn guide 11, which is mounted at the apex of the traversing triangle. As the pivoting movement continues, the pivoting arm performs simultaneously an axial movement, so that the position II is passed. At the same time, the full package is stopped and replaced with an empty tube. Then, the suction head assembly is moved to position III (compare FIG. 11). As it does so, the yarn is, as previously described, placed into the transfer tail device. By the axial displacement of the suction head assembly to position IV, the yarn reaches notch 25 in the empty tube, and is carried along by the empty tube and torn off between the empty tube and the suction head assembly. The yarn is then first wound on the tube to a bead, and, upon actuation of the transfer tail device 15, to a yarn reserve. After having been released by the device 15 and caught by the traverse motion system 6, it is wound into a package. The yarn handling during a subsequent package doff, is conducted as described in conjunction with FIGS. 1–8, with catching position I being in front of the plane of the traversing triangle.

FIGS. 12–14 serve to illustrate the suction head assembly 18, and specifically the yarn catching and yarn cutting means which form a part of the assembly head. The assemblies 18 are located on a tubular cross arm 39, which is open at its one end 40. The number of assemblies 18 corresponds to the number of the packages to be built up on one winding spindle. Preferably, the assemblies 18 are not positioned perpendicularly to the longitudinal axis of the cross arm 39, but are somewhat inclined, which facilitates the flow of the yarn pulled into the cross arm 39. A pressurized air supply line 42 is attached to cross arm 39, and an annular duct 43 which is a part of the assembly 18 receives, via hose connection 52, pressurized air from line 42. The stream of pressurized air entering into the suction head assembly produces a suction at the inlet, by which the yarn is taken in.

In FIG. 13, the traverse stroke is indicated with a dashed line, with traversing yarn guide 8 being shown in solid lines at one end position, and in dashed lines at its other end position. The traversing yarn guide 8 reciprocates the yarn in a vertical plane between the yarn guide 11 and the path of the traversing yarn guide 8 in a so-called traversing triangle. To interrupt this motion, the suction head assembly 18 is moved closely adjacent the traversing triangle, and so that the yarn catching device 44 with its outer portion 45 extends through the plane of the traversing triangle. If the yarn is on the left side of the catching outer portion 45 when same enters into the traversing triangle (FIG. 13), the yarn slides outwardly along the edge 49 which is inclined toward the traversing triangle, while it is being held in the recess 46 of the traversing yarn guide 8. When the traversing yarn guide 8 returns from its right end position, the yarn slides along the other catching edge 48 which is inclined in the same direction. The yarn thus reaches the cutting device, which is positioned in front of the air inlet of the assembly 18.

In the embodiment shown in FIGS. 12–14, the cutting device is a part of the yarn catching device 44. The cutting and yarn catching device 44 is a plate which is attached to the support of the assembly 18. The plate has a surface area 47 which is inclined toward the direction of the advancing yarn, so that it forms an acute angle with the inlet opening surface of the assembly 18. Formed into this surface area 47 is a slot 51 having sharp edges, which is wide in the upper area and forms a cusp in the direction of the running yarn. The edge 48 of catching outer portion 45 ends in this cutting slot 51. When the yarn advancing in direction of arrow 27 enters into this cutting slot 51, it tightens in the cusp of the notch, and is then cut or torn off by the tension which the package exerts on the yarn. The assembly 18 can then remove the yarn end remaining above the slot, which is facilitated by the fact that cutting slot 51 opens in this direction of tension, which is opposite to the direction 27 of the advancing yarn, and therefore it does not exert a retaining force on the yarn. The yarn may then be withdrawn by the assembly 18. A small groove 50 may be formed into the outer face of the head 18' (FIG. 12) across the suction inlet, to guide the yarn. Behind annular duct 43, the yarn enters into the flow of the pressurized air in the cross tube or cross arm 39.

FIG. 15 illustrates how a unit consisting of central tube 41, pivoting arm 17 and cross arm 39 which accommodates the suction head assemblies 18, can be constructed. Central tube 41 may be mounted in the machine frame as shown in FIGS. 10–11, or it may be mounted on the slide as seen in FIGS. 1–5. In either case, it is adapted to pivot about axis of rotation 16 and to be axially displaced along the axis of rotation 16. A stepping motor 62 serves as the pivotal drive, which acts through the gear 53 to drive the gear 54, which remains engaged with gear 53 even during the axial movement of the arm. The axial movement is imparted by grooved drum 55, which is mounted on the pivoting arm, and the drum 55 includes a groove 56 which engages a stationary pin 57. It should be noted that in the illustration, the shape of groove 56 has been randomly selected for graphic reasons, and does not exactly correspond with the previously described course of the pivotal and axial movements of the suction head assemblies.

The pivotal and axially movable portion of the tube 41 is connected via a coupling with a stationary hose 59. Hose 59 terminates in a basket 60, which is penetrable by air, for the collection of fiber and yarn material. In the illustrated embodiment, the coupling 58 consists of two tubes which are concentric and interengage in close contact, one of them being fixedly connected with hose 59, whereas the other is connected with the pivoting tube 41 and so as to be pivotable and axially displacable.

FIG. 16*a* is a schematic front elevational view of a filament spinning apparatus which includes an arrangement of draw rolls 71 consisting of several pairs of draw rolls 72, 72', 72'', 72'''. The apparatus also includes a slide which mounts a yarn suction nozzle 70 which is adapted to move along a course of movements so as to thread up the filament yarns 10, which have been picked up at the outlet of spinning head 35 or the slotted guide tube 36 connected thereto. The arrangement of draw rolls 71 is positioned between the spinning head 35 and the associated yarn guide 11 of winding spindle 2 of FIG. 1 or FIG. 10, respectively.

With the suction device 70 being disposed in its initial position, the filament yarns 10 may be removed from the head, and thereafter a yarn guide is actuated which is mounted on the rear machine wall and adapted to be retracted and extended parallel to winding spindle 2. The guide is thereby designed so as to keep the removed yarns from contacting the finishing roll 73.

To thread up the yarns on the first pair of draw rolls 72, the yarn suction device 70 moves a total of 360 degrees around feed roll 74 and guide roll 75 associated thereto, in a rearmost plane in the direction of arrows 76, 76', 76'' and 76'''. Thus the yarns 10 are placed once around the pair of rolls 72. The device 70 then performs a short axial movement in direction of arrow 77 to a plane which lies in front of the rearmost plane. The yarn is then moved a second time around the pair of rolls 72. The motion cycle is repeated as many times as are required for an adequate number of loopings on the pair of draw rolls, and so that the loopings can take up the necessary retaining and drawing forces without slippage. Then the device 70 moves in a direction tangential to the roll 74 to a treatment chamber 78, for example a heating chamber, so as to place the yarns 10 around the pair of rolls 79, 80 accommodated therein. In this regard, the heating chamber includes a cover, which has been previously opened by an actuating means (not shown). The necessary cycle of motions within the chamber is schematically indicated by arrows 81, 81', 81'', 81'''. It is likewise repeated several times, with an axial movement in direction of arrow 82 following completion of each cycle, so as to prevent the yarns from winding on top of each other. Then the actuating means closes the cover of treatment chamber 78. The device 70 is now so directed that it moves successively, in direction of the advancing yarn, several times completely around the following pairs of rolls 72'' and 72''', so that the yarns are helically guided in several windings around the pairs of rolls.

During the processing and winding of multiple yarns, the yarns are so separated by the axial movement upon completion of each motion cycle, that the yarn windings on each pair of rolls have a greater separation than the distance between the yarns 10 when spread into the shape of a band.

Once the yarns have been placed on all pairs of draw rolls of the roll arrangement 71, they are transferred to an associated winding head which is not shown in this drawing, and which may be constructed as a winding head with a turret, as for example, known from German Patent No. 24 61 223,and U.S. Pat. No. 4,002,307, or to the previously described suction head assembly 18 of the yarn thread-up apparatus. The yarns may be transferred to the associated winding heads by any known technique, such as that disclosed in U.S. Pat. No. 4,416,041. Upon completion of the transfer, the yarns 10 are cut by yarn cutter 83, and the device 70 moves back to its initial position at the end of yarn shaft 35 or guide tube 36, and the supply of pressurized air 84 to the yarn suction device is stopped.

After the yarns 10 placed on the arrangement of draw rolls have been transferred to the thread-up device for the winding head of FIGS. 1–14, the device 70 may carry out additional operational steps, such as inserting the yarns 10 into texturing nozzles for improving their cohesion, placing the yarns 10 into associated, stationary yarn guides at the apexes of the respective traversing triangles, or the insertion of the yarns into yarn tension measuring devices and yarn break detectors.

Figure 16B:
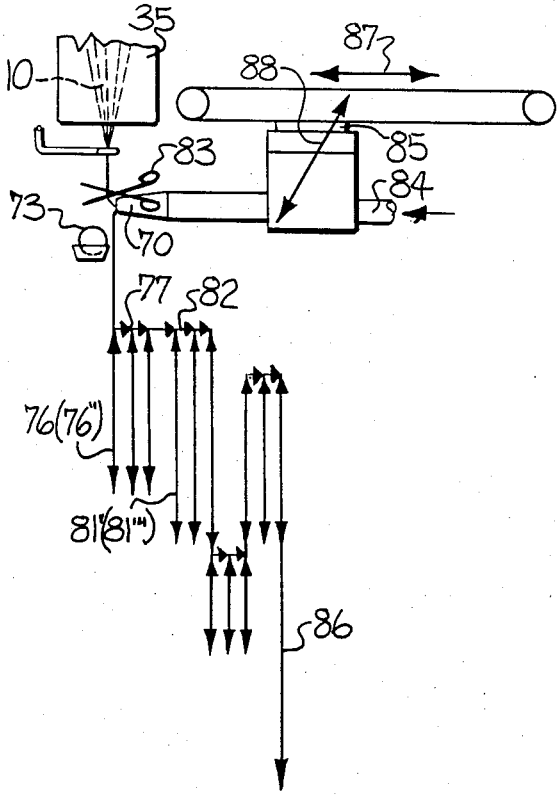

FIG. 17*a* is a side elevational view of the draw roll arrangement 71, and it can be seen that the yarns 10 loop around the individual, axially displaced pairs of rolls several times, and are then placed on the winding spindle and wound next to each other on two winding tubes 3. To this end, the slide with the yarn suction device 70 moves up and down as shown by the arrows in FIG. 17*b*, and reciprocates on a guide rail 85 parallel to the machine front (i.e., perpendicularly to the viewing plane) in such a manner that an essentially closed path line is formed. Upon completion of the full motion cycle, the slide is displaced to the next adjacent outer plane which is, as viewed from the free face of the draw roll, located closer to the free face (note arrow 77 in FIG. 16*b*). The advance in the direction of the draw roll axis may be continuous or in steps, until each pair of rolls 72 to 72''' has been looped as many times as needed. Then the slide is displaced to the next pair of rolls 72', it being preferred that it remains in the normal plane of the pair of rolls 72, from which the previously strung up yarns 10 advance. The looping of the pairs of draw rolls which follow in the direction of the advancing yarns is done similarly to the above description.

The yarn suction device 70, which is fixedly connected with the slide, can be moved vertically, similarly to the trolley of a hoisting unit, and displaced on the guide rail 85 arranged parallel to the longitudinal front of the spinning machine according to the desired course of movements. The yarn suction device 70 can also be displaced on the slide in a direction parallel to the axis of the draw rolls, with each of the movements of the slide schematically indicated by arrows 86, 87, 88, being, for example, actuated by stepping motors which are controlled by a microprocessor.

FIG. 18 illustrates a modified embodiment of the yarn handling apparatus of the present invention. The yarn handling apparatus is movably mounted on the machine frame 1, preferably on the side of slide 4 of the winding apparatus which faces the yarn 10 and traverse motion system 6. More particularly, a slide 91 is vertically displaceably on a vertical support 90 of the machine frame 1. The slide 91 is driven by a cylinder-piston unit 92 without a piston rod, as is described in U.S. Pat. No. 4,153,211 with reference to FIGS. 4–7. For reasons of simplification, the connections for the pressure fluid are not shown in the drawing. Firmly connected to slide 91 is a housing 93, which extends essentially horizontally and on both sides of support 90, and in which a sliding piece 94 can reciprocate in a controlled manner. A double-acting cylinder-piston unit 95 and a servomotor or the like serve for the drive of the sliding piece 94 in each of the two directions. The cylinder-piston unit is fixedly connected to the housing 93 and its piston rod 96 engages with a pin 97 of sliding piece 94.

One end of sliding piece 94 mounts a lever 98.1, which is pivotally supported and non-rotatably connected with the shaft of a drive motor 99. A second lever 98.2 is pivotally mounted on the other end of sliding piece 94, and a blade assembly 101 is interconnected between the outer free ends of the two levers 98.1 and 98.2 by pivot pins 100. Thus the levers 98.1 and 98.2 pivot in unison upon actuation of drive motor 99. The blade assembly 101 includes a pair of parallel blades which are spaced apart in the direction of the running yarn, and the blades include aligned pairs of yarn catching extensions 102, 102.1 disposed in spaced relation one below the other. The blade assembly 101 accommodates as many pairs of yarn catching extensions 102, 102.1 arranged next to each other as there are packages 19 to be produced next to each other on the associated winding spindle 2 (not shown in FIG. 18).

In the area of the yarn extensions 102, 102.1, the blade assembly contains apertures 104, so as to be able to guide the yarns 10 in front of the respective suction head inlets 180 of the yarn suction system 103. The yarn suction system 103 itself is constructed as a box which is mounted on the housing 93 and thus performs the same vertical movements as the slide 91, whereas the blade assembly 101 can be pivoted relative to it in the horizontal plane. For reasons of compensating for the length in the vertical movement of the slide 91, the box 103 of the suction system is connected with a flexible hose 105 to a source of partial vacuum (not shown), so as to transport the removed yarns 10 to a collection container 60 (FIG. 15). Below the suction inlets 180 on the box of the yarn suction system 103 are mounted yarn cutters 106, which are actuated when a yarn 10 caught by the yarn catching extensions 102, 102.1 is guided in front of the yarn suction system 103 and held by the suction inlet 180. The yarn cutters 106 are of conventional design, and they may take the form for example of the cutter illustrated in U.S. Pat. No. 3,526,348.

The described yarn handling apparatus of FIG. 18 can thus be moved up and down by the cylinder-piston unit 92 in the direction of the double arrow 109. In addition, it can perform a translational movement, i.e. a linear movement by actuating the cylinder-piston unit 95, by which piston rod 96 is extended or retracted in the direction of the double arrow 110. This movement can be superimposed on an extending movement of the blade assembly 101, when the motor 99 is actuated in the direction of arrow 111 for pivoting the levers 98.1 and 98.2. By the superimposition of the pivotal and the reciprocal motions of the drive units 95 and 99, it is thus possible to approach all essential points of a horizontal plane of the slide 91, which are positioned in a plane defined by the stroke of the cylinder-piston unit 95, the length of pivotal levers 98.1 and 98.2, and the pivotal angle of drive unit 99.

The operating method of the yarn handling apparatus of FIG. 18 is described in conjunction with Figures **19*a* and 19*b*, which illustrate a front view of the winding apparatus with its lateral yarn changing device, and in which the same reference numerals are used as in FIG. 18. To doff a package, the slide 91 of the yarn thread-up apparatus is moved to its upper position, so as to not interfere with the increasing package 19, and the slide 4 of the winding apparatus moving upwardly. Upon actuation of pivotal drive 99, the yarn catching extensions 102, 102.1 are moved out in their horizontal plane until they have entered into the plane of the advancing yarn between the stationary yarn guide 11 at the apex of the traversing triangle and the traversing yarn guide 8. The traversed yarn 10 is guided along the edges 107.2 of the blades and over the yarn guide edges 107 of the superimposed extensions 102, 102.1, and the yarn then slides under the yarn tension into the respective yarn trap 108 which is formed by inclined pins, gullet teeth and similar yarn guides. Now, the blade assembly 101 with yarn catching extensions 102, 102.1 is pivoted by the actuation of pivotal drive 99, and so guided by the simultaneous actuation of the cylinder-piston unit 95 that the yarns 10 come to lie on their essentially vertical path between the two cooperating extensions 102, 102.1 in front of the suction head inlets 180 of yarn suction box 103. Also, this portion of the yarns pass into the yarn cutter 106. The slide 4 is then moved away from the package surface. This releases the yarns 10 from the traversing yarn guides 8 and the grooved rolls 9, and a binding bead is wound on each package 19 in a plane normal to the winding spindle 2 and which includes the yarn traps 108 of the extensions 102. At this time, the winding spindle is already braked. However, before the yarns slacken, the yarn cutters 106 are actuated and the advancing yarns 10 are grasped and removed by the suction inlets 180 of the yarn suction system 103**.

After the winding spindle 2 has been braked and the package 19 been exchanged for an empty tube, the slide 4 is lowered until grooved roll 9 or drive roll 5, as is additionally provided in a winding apparatus according to FIG. 1, drives the empty tube and accelerates it to the full circumferential speed. As shown in FIG. **19*b*, slide 91 of the yarn thread-up apparatus with the yarns 10 being held in suction inlets 180 is moved to its lower position, and pivotal drive 99 is actuated so that angle rail 101 with yarn catchers 102 comes to lie behind the vertical plane in which the longitudinal axis of winding spindle 2 is located. The advancing yarns thus contact the circumference of the winding tubes. By moving out the device 114 for forming a yarn reserve (as is known, for example, from German Patent No. 25 47 401 and U.S. Pat. No. 4,146,186), the yarns are prevented from falling into the traversing plane between the stationary yarn guide 11 in the apex of the traversing triangle and the traversing yarn guide 8. At this time, the cylinder-piston unit 95 is actuated, so that the extensions 102 move in a direction parallel to the axis of the winding spindle 2, and so that the yarns 10 are caught by the conventional notches or the like provided in the empty tubes, and wound thereon. Then, in successive operations, the yarns 10 advancing to suction inlets 180 are torn off, a yarn reserve is wound on each empty tube by the actuation of device 114, and yarns 10 are caught by the self-catching traversing yarn guides 8. Upon completion of the initial windings, drives 99 and 92 are so actuated that the yarn handling apparatus is returned to its standby position of FIG. 19***a*, in which the blade assembly 101 is pivoted back and rests against yarn suction box 103. The normal traversing of the yarns 10 starts as soon as the reserve forming devices 114 have returned to their initial position, and the self-catching traversing yarn guides 8 have grasped the yarns.

FIG. 20 schematically illustrates the relative relationship of a spinning machine 130 having the individual winding positions 160, with the microprocessor 122 associated to spinning machine 130, the empty tube transport carriage 126, the package doffing carriage 131, and the creel 132. As can be seen, the empty tube carriage and the package doffing carriage can be operated independently of each other, and are connected with microprocessor 122 via trailing lines 127 or 128, respectively. The microprocessor 122 is connected via lines 129 with the individual winding positions 160 as well as the yarn handling devices associated thereto, so that the microprocessor assumes the central control of the winders 160, the yarn handling devices of the present invention, the empty tube carriage 126 and the package doffing carriage 131. Creel 132 may be positioned at any desired point along the trackway 121. The separation of the yarn handling function on one hand and package doffing function on the other, as is known from U.S. Pat. No. 4,340,187, makes the package doffing carriage 131 free to deliver the packages from the individual winding positions 160 to creels 132, without interfering with the handling of the yarn by the devices of the present invention.

FIGS. 21*a*–21*d* show the package doffing carriage in the several phases of its operation. Package doffing carriage 131 travels along tracks 121, and it has on its base plate a column 134 along which slide 135 can move. Slide 135 possesses a cross bar 136 along which a trolley 137 travels, and which has an axis of rotation 138 parallel to the column 134 on which a sliding block 144 is mounted. A U-shaped supporting arm 139 with receiving pin 140 moves in sliding block 144 in the plane of the U. The corresponding drives are here not shown in detail; however, as can be seen from the illustration, the receiving pin 140 can move upwardly, as well as perform a pivoting motion.

Figure 21A:
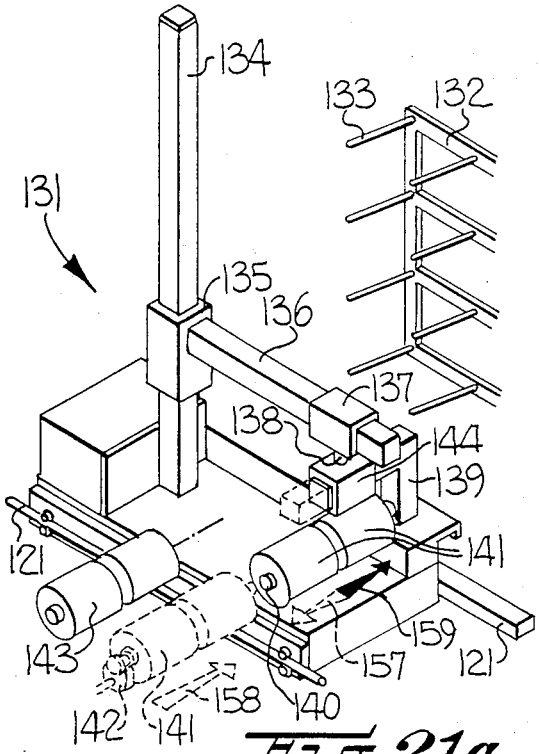

FIG. 21*a* also shows a creel 132 with several receiving pins 133. Further shown in FIG. 21*a* are packages 143 which are still on the winding spindles and still being wound, and full packages 141 of two winding heads with pushing devices 142.

As can be seen in FIG. 21*a*, receiving pin 140 of package doffing carriage 131 is brought into alignment with the winding spindle after the spindle has been stopped. Then, the U-shaped support arm 139 is displaced in sliding block 144 until the receiving pin almost contacts the face of the winding spindle (movement 157). The pushing device 142 is actuated and performs movement 158, as can be seen in FIG. 21*a*. To start the operation, receiving pin 140 is preferably equipped on its front face with a source of light and a photocell, whereas the face of the spindle has a series of light-reflecting foils or sheets on its circumference. As a result, a series of impulses is generated by the rotation of winding spindle, which is evaluated by microprocessor 122, so that the microprocessor can collect the rated speed of the spindle, the braking phase, the acceleration phase and the standstill of the spindle. A signal emitted by the microprocessor 122 and which indicates the shutdown of winding spindle activates pushing device 142. Since the pushing device reaches behind the bobbin tubes of the full packages, the two full packages 141 are pushed on receiving pin 140 of the package doffing carriage 131. Now the U-shaped supporting arm 139 returns to its initial position performing movement 159 (Figure 21*a*)

Figure 21B:
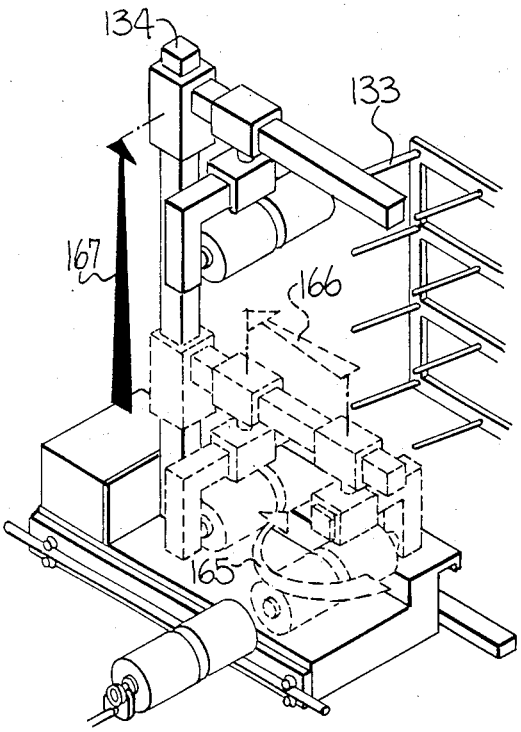
Figure 21C:
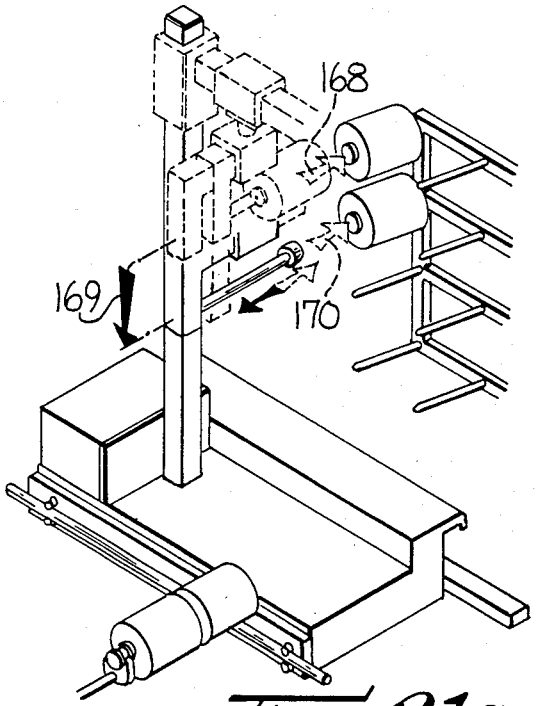
Figure 21D:
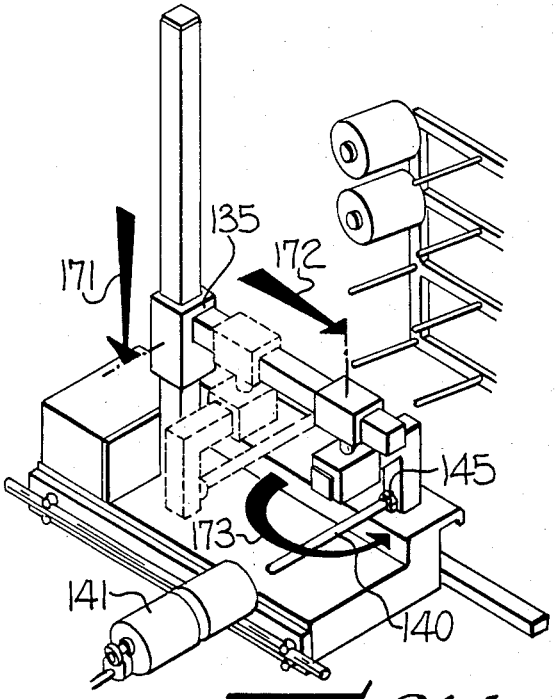

In FIG. 21*b*, the package doffing carriage transports the full packages to a creel 132. By movements 167, 168, 169, 170 the packages are individually distributed by the pushing device 145 of the package carriage 131 to receiving pins 133 of the creel (FIG. 21*c*). By movements 171, 172, and pivoting motion 173 of pin 140, the pin 140 is realigned with another shut-down winding spindle with full packages 141.

FIG. 22 illustrates a tube transporting carriage which travels on wheels 180 along the trackway 121 adjacent the machine front. The tube carriage has a magazine 181 for empty tubes 183, and the magazine has an opening 184 in which two aligned empty tubes 183 are exposed. A clamping device 182 is provided which is suitable to move into opening 184 and to clamp one or also several aligned tubes between two grippers. For this purpose, an arm 186 is provided which pivots about an axis of rotation 187. The pivoting motion is effected by cylinder-piston unit 188. At 119 a winding spindle is indicated which is part of the winding apparatus on a textile machine. Arm 186 is adapted to be pivoted and positioned, so that the empty tubes 183 clamped by clamping device 182 are aligned with the spindle 119. Further, arm 186 can be displaced by a suitable drive means (not shown) along axis 187 until the clamped empty tubes 183 and spindle 119 are at the most slightly spaced apart from each other. With the use of drive motor 185 and a suitable pushing means (for example, a circulating chain), the tubes can now be axially pushed out of clamping device 182 and placed on the winding spindle 119. Drive elements which are suitable for this purpose are disclosed, for example, in German Offenlegungsschrift No. 21 23 689 and corresponding U.S. Pat. Nos. 3,895,725 and 3,987,974; and German Offenlegungsschrift No. 21 28 974 and corresponding British Pat. No. GB 1,399,891.

In the drawings and specification, there has been set forth preferred embodiments of the invention, and although specific terms are employed, they are used in a generic and descriptive sense only, and not for purposes of limitation.

That which is claimed is:

1. A textile yarn winding machine having a plurality of yarn winding positions aligned along at least one side thereof, and with each winding position comprising at least one winding spindle adapted for coaxially receiving two or more bobbin tubes, yarn traversing means for traversing each of a plurality of running yarns along a predetermined yarn traverse stroke to form a cross wound yarn package upon each associated bobbin tube, and a plurality of yarn handling assemblies operatively associated with each winding position, with each of said yarn handling assemblies being associated with a respective one of said yarns being wound at said position and comprising (a) yarn catching means, (b) yarn severing means for severing the running yarn while the yarn is disposed in said yarn catching means, and (c) yarn suction means for withdrawing the severed yarn end from said yarn catching means, and means mounting each assembly for movement along a predetermined path of travel between a first end position located on the upstream side of said winding spindle and wherein said yarn catching means is disposed in said predetermined yarn traverse stroke so that the running yarn moves into said yarn catching means where it is adapted to be severed and withdrawn by said severing means and said suction means, and a second end position located on the opposite side of said winding spindle and where the running yarn is adapted to be engaged by a yarn catching and severing notch or the like on the asociated empty bobbin tube mounted on said winding spindle and then again engaged by said yarn traversing means to commence winding of the running yarn upon the empty bobbin tube.

2. The textile yarn winding machine as defined in claim 1 wherein each winding position further comprises a slide disposed on one side of said winding spindle, with said slide mounting said yarn traversing means and a drive roll for operatively engaging said packages being wound upon said winding spindle, and means mounting said slide for movement away from said winding spindle so as to accommodate the build of the packages being wound.

3. The textile yarn winding machine as defined in claim 2 wherein said means mounting each assembly comprises lever arm means mounted for pivotal movement about an axis disposed parallel to the axis of said winding spindle, with each assembly being mounted at the end of said lever arm means opposite said pivotal axis.

4. The textile yarn winding machine as defined in claim 3 wherein said lever arm means is also movable in a direction parallel to its pivotal axis, and further comprising means for moving said lever arm means along a predetermined pivotal and axial path of movement and such that said predetermined path of travel of each of said assemblies includes a pivotal and an axial component.

5. The textile yarn winding machine as defined in claim 4 wherein said lever arm means is pivotally mounted to said slide.

6. The textile yarn winding machine as defined in claim 4 wherein said lever arm means is pivotally mounted to said machine at a fixed location with respect to said winding spindle.

7. The textile yarn winding machine as defined in claim 4 wherein said lever arm means comprises telescopically interconnected tubes.

8. The textile yarn winding machine as defined in claim 1 wherein said means mounting each assembly further comprises a tubular member extending parallel to said winding spindle, and wherein said yarn suction means of each assembly comprises a suction inlet communicating with said tubular member for receiving and withdrawing the running yarn through said tubular member.

9. The textile yarn winding machine as defined in claim 8 wherein said tubular member is connected to a source of pressurized air so that the air flows through said tubular member, and said suction inlet of each assembly comprises an air injector such that air is drawn therethrough by the flowing pressurized air.

10. The textile yarn winding machine as defined in claim 8 wherein said means mounting each assembly comprises means for moving said tubular member along its axial direction as well as along a lateral direction which is generally parallel to the direction of the running yarn.

11. The textile yarn winding machine as defined in claim 1 wherein each winding position further includes transfer tail forming means associated with each running yarn for temporarily holding the running yarn outside of the predetermined yarn traverse stroke immediately after its being caught by the yarn catching and severing notch on the associated bobbin tube and so as to form a transfer tail on the tube.

12. The textile yarn winding machine as defined in claim 1 wherein said yarn catching means comprises a blade having a slot therein, and wherein said slot includes one edge surface which extends outwardly beyond the opposite edge surface, and with said one edge surface being inclined with respect to the traversing direction of the running yarn so as to guide the running yarn into said slot.

13. The textile yarn winding machine as defined in claim 12 wherein at least one of said edge surfaces of said slot is sharpened to define said yarn severing means.

14. The textile yarn winding machine as defined in claim 1 wherein said yarn handling means for each winding position further comprises a housing which extends generally parallel to the axis of the associated winding spindle, and wherein each of said yarn suction means comprises a suction inlet in said housing and means for drawing air through said inlet and into said housing.

15. The textile yarn winding machine as defined in claim 14 wherein said yarn catching means comprises a blade assembly extending in a direction generally parallel to the axis of the winding spindle, and means mounting said blade assembly to said housing for movement between an extended position spaced outwardly from said housing and a withdrawn position adjacent said housing.

16. The textile yarn winding machine as defined in claim 15 wherein said yarn severing means is mounted on said housing adjacent said suction inlet, and wherein said yarn severing means and said suction inlet are disposed adjacent said blade assembly when said blade assembly is moved to said withdrawn position.

17. The textile yarn processing machine as defined in claim 16 wherein said blade assembly is mounted for pivotal movement about an axis which is generally parallel to the direction of the running yarn.

18. The textile yarn winding machine as defined in claim 17 wherein said blade assembly comprises a pair of blades which are spaced apart in the direction of the running yarn, with said blades including aligned extensions which collectively define a yarn receiving slot, and wherein said yarn severing means and said suction inlet are located between said blades when said blade assembly is pivoted to said withdrawn position.

19. The textile yarn winding machine as defined in claim 1 further comprising a carriage adapted for movement along the side of the textile yarn winding machine, and means mounted on said carriage for receiving and supporting full bobbin packages from a winding spindle of the textile yarn winding machine.

20. A textile yarn winding machine as defined in claim 19 further comprising a second carriage adapted for movement along the side of the textile yarn winding machine, and means mounted on said second carriage for supporting a plurality of empty bobbin tubes, and means for transferring said empty bobbin tubes onto a winding spindle of an adjacent winding position.

21. The textile yarn winding machine as defined in claim 1 wherein said winding machine further comprises a plurality of draw rolls mounted upstream of each of said winding positions, and movable yarn suction means for threading the running yarn about said draw rolls.

22. The textile yarn winding machine as defined in claim 21 wherein said draw rolls are disposed in associated groups of rolls, and wherein said movable yarn suction means comprises a suction tube for receiving an end of the running yarn, and means for selectively moving said suction tube several times about the complete periphery of each of the associated groups of draw rolls, while advancing the suction tube in an axial direction so as to helically wind the advancing yarn about each group of associated draw rolls.

23. A textile yarn winding machine having a plurality of yarn winding positions aligned along at least one side thereof, and with each winding position comprising at least one winding spindle adapted for coaxially receiving two or more bobbin tubes, yarn traversing means for traversing each of a plurality of running yarns along a predetermined yarn traverse stroke to form a cross wound yarn package upon each associated bobbin tube, and a plurality of yarn handling assemblies operatively associated with each winding position, with each of said yarn handling assemblies being associated with a respective one of said yarns being wound at said position and comprising (a) yarn catching means including a yarn receiving slot, (b) yarn severing means for severing the running yarn while the yarn is disposed in said slot of said yarn catching means, and (c) yarn suction means for withdrawing the severed yarn end from said slot of said yarn catching means, means mounting each assembly for movement along a predetermined path of travel between a first end position located on the upstream side of said winding spindle and wherein said yarn catching means is disposed in said predetermined yarn traverse stroke so that the running yarn moves into said slot where it is adapted to be severed and withdrawn by said severing means and said suction means, and a second end position located on the opposite side of said winding spindle and where the running yarn is adapted to be engaged by a yarn catching and severing notch or the like on the associated empty bobbin tube mounted on said winding spindle and then again engaged by said yarn traversing means to commence winding of the running yarn upon the empty bobbin tube, and means for moving each assembly along its predetermined path of travel.

24. The textile yarn winding machine as defined in claim 23 wherein said slot of said yarn catching means includes two guiding edges, with the direction of at least one of said guiding edges being inclined with respect to the direction of said traverse stroke to form an acute angle with the plane through which the yarn is traversed.

25. The textile yarn winding machine as defined in claim 24 wherein said guiding edges converge with respect to each other and form yarn trap means which readily receives the yarn but resists lateral withdrawal thereof.

* * * * *